US006920746B2

(12) United States Patent
Weide et al.

(10) Patent No.: US 6,920,746 B2
(45) Date of Patent: Jul. 26, 2005

(54) OPEN-END SPINNING DEVICE

(75) Inventors: Thomas Weide, Mönchengladbach (DE); Lothar Winzen, Erkelenz (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 54 days.

(21) Appl. No.: 10/718,949

(22) Filed: Nov. 21, 2003

(65) Prior Publication Data

US 2004/0103634 A1 Jun. 3, 2004

(30) Foreign Application Priority Data

Nov. 21, 2002 (DE) ..... 102 54 272

(51) Int. Cl.[7] ..... D01H 4/10
(52) U.S. Cl. ..... 57/404; 57/416; 57/417
(58) Field of Search ..... 57/404–417

(56) References Cited

U.S. PATENT DOCUMENTS 3,958,403 A * 5/1976 Wehling ..... 57/410
5,540,044 A 7/1996 Raasch ..... 57/417

FOREIGN PATENT DOCUMENTS

DE 1 917 864 A1 12/1969
DE 2 126 841 5/1971
DE 24 21 415 A1 11/1975
DE OS 25 52 955 A1 8/1976
DE 39 42 454 A1 6/1991
DE 44 11 342 A1 10/1995
DE 195 28 727 C2 2/1996
DE 199 63 087 A1 6/2001

OTHER PUBLICATIONS

German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

An open-end spinning device has a spinning rotor (2) with a rotor groove (25) at its greatest inside diameter in which fibers are collected. A yarn shank (27) extending from a yarn withdrawal nozzle to the rotor groove (25) is curved in the vicinity of the rotor groove (25) counter to the direction of rotor rotation during the spinning process forming a lagging tie-up zone whereat yarn formation takes place. A rotor insert (18) is rotatably supported within the spinning rotor coaxially to the rotor axis. The rotor insert (18) can be caused to rotate in a contactless manner by the rotation of the spinning rotor. The rotor insert (18) comprises a yarn guide conduit (20) that receives the yarn shank (27) to effect a retardation of the rotor insert (18) during normal spinning operation, which significantly improves the stability of the spinning process over known open-end spinning devices.

13 Claims, 4 Drawing Sheets

OPEN-END SPINNING DEVICE

CROSS-REFERENCES TO RELATED APPLICATIONS

This application claims the benefit of German patent application 10254272.4 filed Nov. 21, 2002, herein incorporated by reference.

BACKGROUND OF THE INVENTION

The present invention relates to an open-end spinning device with a spinning rotor rotating in a rotor housing.

German Patent Publication DE-OS 25 52 955 teaches rotatably supporting a spinning insert inside the spinning rotor of an open-end spinning device. The rotor shaft of the spinning rotor is designed as a hollow shaft and rotates on a support disk mounting. The drive and bearing shaft of the spinning insert, also referred to as a rotor insert, is supported in the hollow shaft by roller bearings. The spinning rotor and the spinning insert are driven by a common tangential belt and rotate in the same direction. In order to achieve a necessary speed difference between the spinning rotor and the spinning insert in such rotor spinning devices, the drive whorls of the two shafts have different dimensions. The open-end spinning device of German Patent Publication DE-OS 25 52 955 is intended to be able to eliminate disadvantages in the nature of the rotor-spun yarn such as, e.g., reduced yarn strength, that are inherent in a yarn produced with the rotor spinning method in contrast to the ring spinning method. However, open-end rotor spinning devices of this type have not proven themselves in practice.

German Patent Publication DE 44 11 342 A1 also describes an open-end spinning device with a spinning insert rotatably supported in the spinning rotor. The spinning insert can be intermittently fixed on the spinning rotor via a coupling device. In normal spinning operation the spinning insert is entrained exclusively by the yarn. This is possible because the yarn can pull the spinning insert along with itself in the direction of rotation by leading of the so-called tie-up zone at which fibers collected within the rotor groove become twisted with a trailing shank of previously formed yarn and are withdrawn therewith from the rotor through a yarn withdrawal nozzle. It is possible by means of the coupling device to accelerate the spinning insert to the rotor speed in the acceleration phase of the spinning device, i.e., during start up of the spinning device such as following a batch change or a yarn break, by entraining the spinning insert via the coupling device with the spinning rotor. This can avoid an overloading of the yarn during a piecing or start up operation that could result in a yarn break or in failure of the piecing operation. German Patent Publication DE 44 11 342 A1 states that so-called belly bands are produced by yarns that are constantly being newly fed in. These belly bands should be able to be reliably avoided if the yarn is protected relatively well from fibers exiting from the fiber guide conduit by a guide conduit in the spinning insert. However, German Patent Publication DE 44 11 342 A1 was based on insufficient data. It was not recognized that the production of belly bands does not take place in the area between the rotor groove and the withdrawal nozzle but rather during the tie-up process of the yarn in the tie-up zone, as is explained in detail, e.g., in German Patent Publication DE 199 63 087 A1. Therefore, the undesired production of belly bands with the device of German Patent Publication DE 44 11 342 A1 is not prevented or is prevented only insufficiently.

German Patent Publication DE 195 28 727 A1 shows an open-end rotor spinning machine with an external rotor in which a rotor insert, designated as an internal rotor, is arranged that is driven independently of the external rotor. The external rotor as well as the internal rotor are each caused to rotate by separate tangential belts. The rotational speed of the internal rotor is always somewhat greater than the circumferential speed of the external rotor during the operation of spinning and during yarn piecing. The fibers are drawn from the rotor groove, designated as a collector groove, via a withdrawal conduit and formed thereby into a yarn. The internal rotor is also called a stretch rotor in German Patent Publication DE 195 28 727 A1 since a certain stretching of the yarn should be able to be achieved. Between the rotor groove and the withdrawal conduit, the yarn runs through a yarn guide conduit, designated here as a yarn conduit, in the internal rotor and is guided during this time by surfaces in the yarn conduit that are curved in the direction of rotation of the rotors. The yarn conduit is designed in such a manner as to prevent fibers from the rear side (as viewed in the direction of rotation) from entering from the rotor groove. The yarn formation should take place in such a manner with the yarn conduit curved in the direction of rotation of the internal rotor and of the external rotor that no undesired belly bands, designated as cover fibers, or alternatively called string winding fibers in German Patent Publication DE 195 28 727 A1, occur. In particular, the fact that no yarns from the rear side of the yarn conduit (as viewed in the direction of rotation) can pass into the fiber bundle drawn off from the rotor groove is supposed to contribute to this effect.

However, the occurrence of cover fibers cannot be prevented with the device according to German Patent Publication DE 195 28 727 A1 for the same reasons as in the case of German Patent Publication DE 44 11 342 A1. The open-end rotor spinning machine described in German Patent Publication DE 195 28 727 A1 operates with a curvature of the yarn end in the tie-up zone oriented to extend in the same direction of rotation as the spinning rotor, referred to as a so-called leading tie-up zone. In this case, fibers coming from the fiber slide surface of the rotor that directly reach the tie-up zone of the yarn end are first joined to the rotating yarn in a direction opposite the normal direction of yarn rotation, after which the direction of rotation of these fibers changes into the main direction of rotation of the yarn during the further withdrawal of the yarn with the simultaneous rotation of the same about its own axis. In particular, when the fiber first reaches the tie-up zone with its end located in front in the direction of rotor rotation, several locally concentrated loops, i.e., the so-called belly bands, can be produced during the change of direction of rotation that results as the tie-up zone progresses. A shrinkage of the yarn occurs at this point with the consequence of non-uniformity of the yarn and of a braked propagation of rotation, which for its part results in a loss of strength in the yarn.

On the other hand, German Patent Publication DE 199 63 087 A1 describes a method of open-end rotor spinning in which of the yarn end is oriented to assume a curvature at the tie-up zone counter to the rotational direction of the spinning rotor, referred to as a so-called lagging tie-up zone. This has the consequence that individual fibers reaching the yarn end in the tie-up zone are immediately tied on or up in the normal direction of rotation of the yarn and thus do not cause any disturbance in the production of yarn with resulting quality defects. The tie-up zone consequently lags behind with a speed of rotation lessened by the speed of yarn withdrawal.

As a result of this lagging of the tie-up zone the fibers are withdrawn from the rotor groove under a greater tractive stress. This creates an additional stretching that results in an improved orientation of the fibers and makes possible a greater utilization of the fiber substance strength. The yarn produced in this manner has, in contrast to a yarn produced with a leading tie-up zone, a pronounced yarn core of stretched fibers.

German Patent Publication DE 199 63 087 A1 further states that the processes could be distinctly improved in the framework of the further development of the open-end spinning methods so that normally rather large accumulations of fibers, contaminations or even a vacuum loss are avoided. It is thus the case today, it is stated, that in principle modern open-end rotor spinning machines operate without additional auxiliary aids for maintaining the curvature of the yarn end in the direction of rotor rotation.

The fact that the fibers are tied up into the yarn end with the same orientation with which they were transported through the fiber guide conduit into the spinning rotor also has an advantageous effect on the yarn structure in the case of a lagging tie-up zone. The tangential alignment of the fiber current in the direction of rotor rotation also assures a stretching of the fibers. In contrast to the known state of the art, the infeed of fibers in the direction of rotor rotation itself results in a fair stability of the yarn manufacturing process. There is also no suggestion in the method according to German Patent Publication DE 199 63 087 A1 to strive for a further stretching by the use of an internal rotor and therewith an only marginal improvement of the yarn. This marginal improvement is not worth the expense for an internal rotor.

A fairly good stability of the yarn production process results from the fiber infeed in the direction of spinning of the rotor. Since an improved stretching is achieved in the method according to German Patent Publication DE 199 63 087 A1, the need of using an inner rotor with the goal of increasing the stretching also does not result in this device. The method of German Patent Publication DE 199 63 087 can not always satisfy the current high demands as regards the stability of the spinning process.

However, it cannot be completely excluded as regards the stability of the spinning process that a spinning process with a lagging tie-up zone could change into a spinning process with a leading tie-up zone. Therefore, the method according to German Patent Publication DE 199 63 087 A1 can not always satisfy the high demands of the present time.

SUMMARY OF THE INVENTION

In view of the state of the art the cited above, it is accordingly an object of the present invention to improve the known open-end rotor spinning devices.

The present invention addresses this objective by providing an open-end spinning device for spinning fibers into a yarn comprising a rotor housing, a spinning rotor disposed for rotation in the rotor housing for receiving the fibers to be spun into the yarn, and a yarn withdrawal nozzle for withdrawal therethrough of the yarn. The spinning rotor has a circumferential rotor groove at a greatest inside diameter within the rotor for collecting the fibers to be spun into yarn, and the rotor defines a lagging fiber tie-up zone at which a yarn shank extends from the yarn withdrawal nozzle to the rotor groove in a curvature at least in the vicinity of the rotor groove counter to the direction of rotation of the rotor. In accordance with the present invention, a rotor insert is rotatably supported within the rotor coaxially therewith, and an arrangement is provided for causing the rotor insert to rotate in the direction of rotation of the spinning rotor at a rotational speed retarded from the rotational speed of the spinning rotor by an amount corresponding substantially to a lag of the tie-up zone. The rotor insert has a guide portion for guiding the yarn shank between the rotor groove and the yarn withdrawal nozzle and for supporting the curvature of the yarn shank counter to the direction of rotor rotation in all spinning phases.

The open-end spinning device designed in accordance with the invention results in a significant improvement in the stability of the spinning process utilizing a lagging tie-up zone that reaches a surprisingly large extent. A disadvantageous changing from a spinning process with a lagging tie-up zone into a spinning process with a leading tie-up zone can thus be avoided during the ongoing spinning process. The drive of the rotor insert in accordance with the present invention assures that its yarn guidance tensions the yarn shank between the withdrawal nozzle and the rotor groove in such a manner that a tilting of the orientation of the yarn shank between lagging and advancing cannot be brought about even by the airflow directed against the rotation of the yarn shank.

The yarn moved in the direction of the rotor groove is caught by the yarn guide of the rotor insert as a consequence of the drive of the rotor insert even in the spinning start phase and is curved around this yarn guide counter to the direction of rotation so that a direction of curvature automatically results that is typical for a lagging tie-in zone.

The force that, on the one hand, tensions the yarn shank between the withdrawal nozzle and the rotor groove causes, on the other hand, a delay of the rotor insert relative to the spinning rotor.

A delay of the rotor insert relative to its drive synchronous with the spinning rotor during normal spinning operation by the yarn shank cooperating with the yarn guidance represents an especially simple adjusting of the suitable speed of the rotor insert.

Coupling the rotor insert to the spinning rotor in a contactless manner and bringing about a direction of rotation of the rotor insert and the rotor in the same direction, preferably by the magnetic effect of permanent magnets, constitute an especially simple and functionally reliable design of the device of the present invention. During the coupling by such magnets, hysteresis acts in the ferromagnetic material of the rotor, that is, the coupling acts substantially according to the principle of a vortex flow. A magnetically-initiated greater support friction can also be achieved that additionally or by itself assures the corresponding entrainment of the rotor insert. The speed of the rotor insert can be adapted during joining to the speed of the spinning rotor. The permanent magnets can be fixed permanently on the rotor insert. Additional drive devices or control devices for imparting rotary motion to the rotor insert are not necessary. The space requirement of the permanent magnets is small. They can be readily integrated into the rotor insert and require no additional construction space. This is especially advantageous, since the available construction space inside the spinning rotors is very limited.

In a preferred embodiment, the yarn guide has a yarn guide conduit having an entrance opening on a side of the rotor insert facing the rotor groove, with the yarn guide conduit being configured to support and maintain the curvature of the yarn shank counter to the direction of rotor rotation. A yarn guide of such design improves the stability of the spinning process.

It is further preferred that the rotor insert have surfaces bordering front and rear sides of the yarn guide conduit (as viewed in the direction of rotation of the yarn guide conduit), with the rear side surface forming an extension of the yarn guide conduit. This design readily results in a prolongation of the fiber guide conduit, in which an additional stabilizing of the yarn formation process takes place during operation since the yarn is extensively covered in the direction of rotation up to the rotor groove and thus is particularly protected from air currents.

If the edge of the recess of the rotor insert is designed as an oblique surface, this counteracts any undesired deposits, e.g., of short fibers, in the recess. Such deposited short fibers might loosen as an accumulation and then result in yarn errors or disturbances in the spinning process.

If the rear (in the direction of rotation) side of the yarn guide conduit is configured to capture the yarn shank, an extremely rapid joining of fibers is supported.

An open-end spinning device in which the yarn guide of the rotor insert is designed to comprise one or more yarn entrainment elements for guiding of the yarn shank and wherein each of the entrainment elements comprises a permanent magnet can be manufactured in an especially simple and economical manner. The yarn shank can be grasped more rapidly and more reliably with a design utilizing plural yarn entrainment elements in such a manner that a lagging tie-in zone is formed. A balancing of the rotor insert can be entirely or largely eliminated by an appropriate axially symmetric arrangement of the elements. The position of the permanent magnets to be removed as far as possible from the axis of rotation has the result that the forces attack a large lever arm, as a consequence of which the contactless transfer of the direction of rotation from the spinning rotor to the rotor insert is improved, in particular during a spinning start. The position of the permanent magnets of the entrainment elements favors a contactless transfer of the rotary motion from the spinning rotor onto the rotor insert.

The invention also alternatively comprises separate drives for the spinning rotor and the rotor insert that are synchronized in such a manner that a suitable relation of the rotary movements of the spinning rotor and of the rotor insert result.

The open-end spinning device in accordance with the present invention assures a very good stability of the spinning process from the joining phrase such as has previously not been achieved in rotor spinning with a lagging tie-up zone. The expense required for this can be kept low. A spinning process with lagging tie-up zone can be smoothly adjusted that is extremely stable from the start.

Further details, features and advantages of the present invention will be explained and understood from the following description of exemplary embodiments with reference to the accompanying drawing figures.

DESCRIPTION OF THE PREFERRED EMBODIMENT

Figure 1:
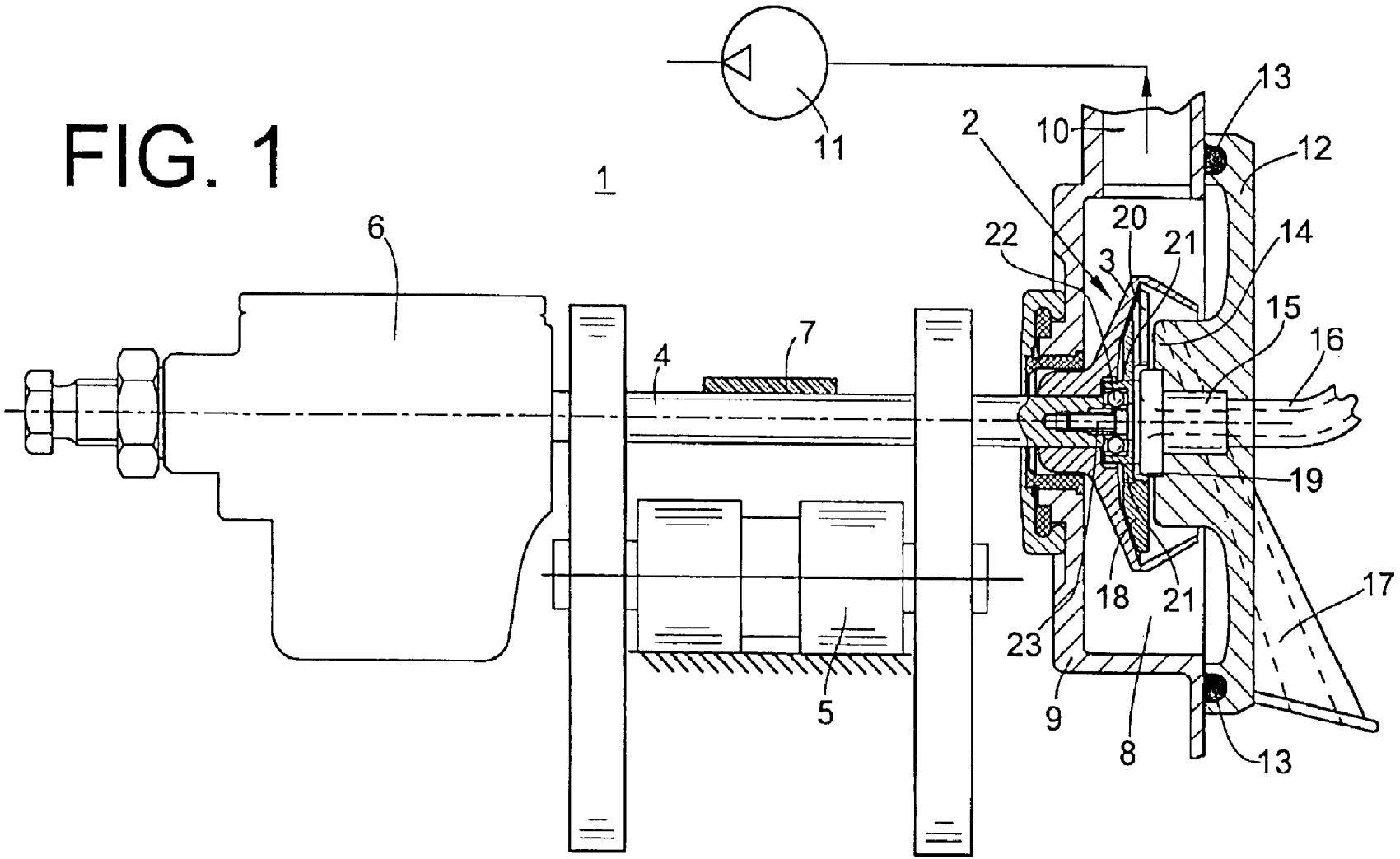
FIG. 1 is a schematic side elevational view, partially in cross-section, of an open-end rotor spinning device with a rotor insert arranged inside the spinning rotor in accordance with one preferred embodiment of the present invention.

Referring now to the accompanying drawings and initially to FIG. 1, an open-end spinning device 1 comprises spinning rotor 2 having a rotor plate 3 and a rotor shaft 4. Rotor shaft 4 is received in a support disk bearing assembly 5 and is fixed in the axial direction of the shaft 4 by an axial support 6. Spinning rotor 2 is driven by an endless flat belt 7. A rotor housing 9 forms a vacuum chamber 8 in which the rotor plate 3 rotates. Vacuum chamber 8 communicates via a line 10 with a vacuum source 11 and is closed essentially airtight during spinning operation by a conduit plate 12 with the aid of a ring seal 13. Conduit plate 12 has a conduit plate hub portion 14 in which a yarn withdrawal nozzle 15 and a yarn withdrawal tube 16 are held. The fibrous material of a sliver opened into individual fibers is drawn into rotor plate 3 by suction through a fiber guide conduit 17 via the vacuum prevailing in the rotor housing 9.

A rotor insert 18 is rotatably supported on rotor shaft 4 inside rotor plate 3. The rotor insert 18 has a recess 19 on its front side into which the yarn withdrawal nozzle 15 extends. A yarn guide conduit 20 is formed in the rotor insert 18 to extend from the recess 19 in a radially outward direction to the outer edge of the rotor insert 18. Cylindrical permanent magnets 21 are inserted into and fixed to the rotor insert 18. Rotor insert 18 is supported by a roller bearing 22 fastened on rotor shaft 4 by the inner bearing ring of the roller bearing 22 via a screw 23.

Figure 2:
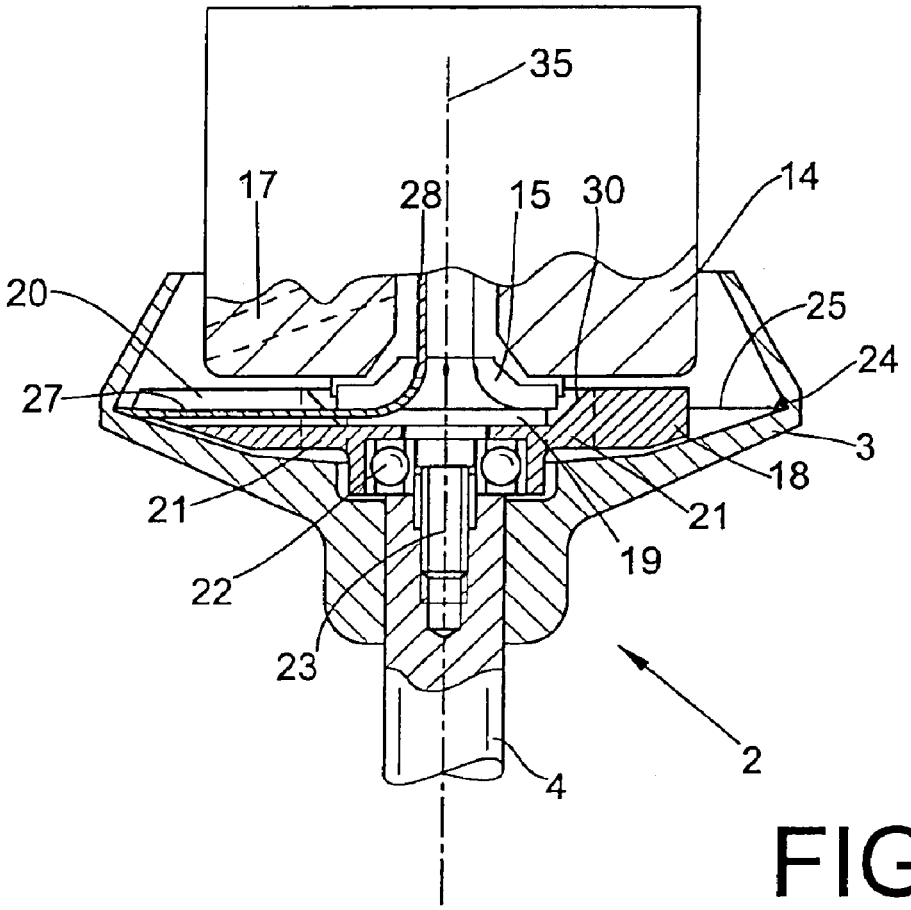
FIG. 2 is a schematic partial cross-sectional view of the open-end rotor spinning device of FIG. 1 on an enlarged scale.
Figure 3:
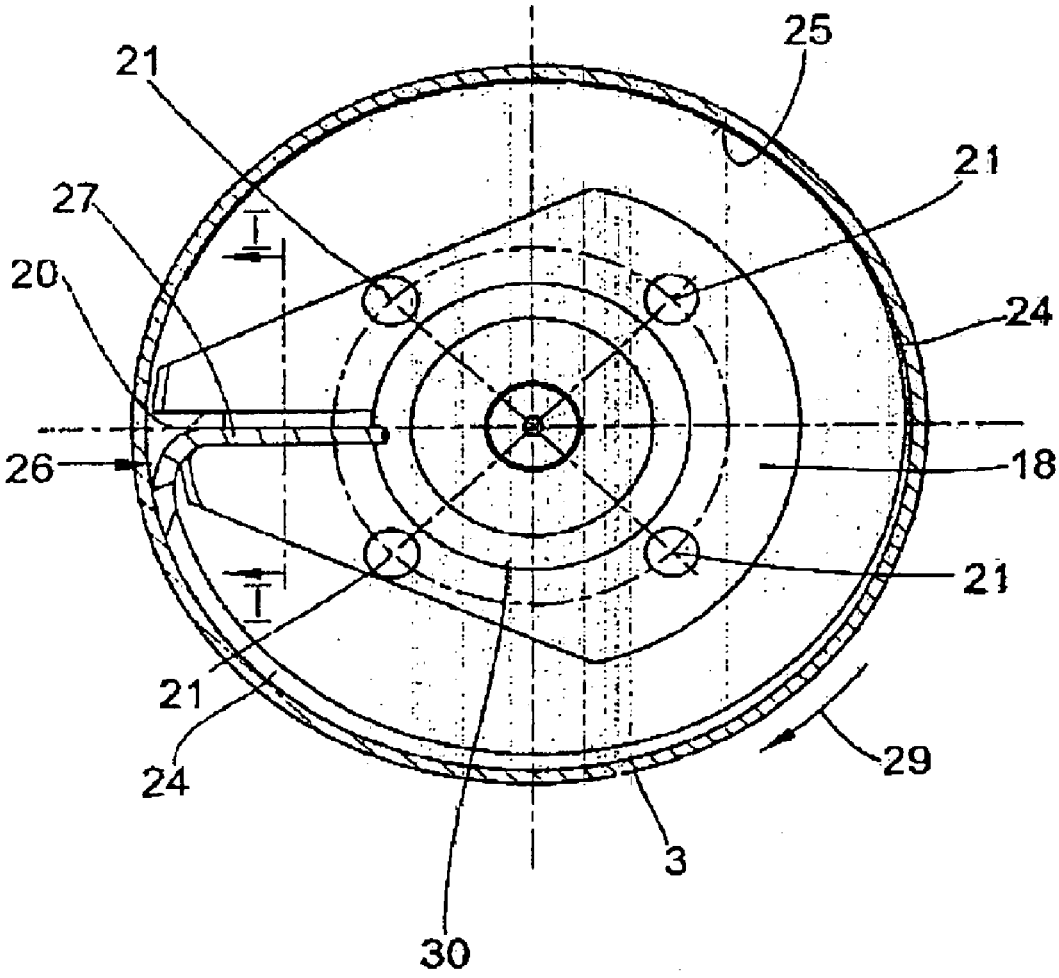
FIG. 3 is an end view in partial section of the spinning rotor of FIG. 2 showing the mounted rotor insert.

FIG. 2 shows the rotor plate 3 of the spinning rotor 2, the rotor insert 18 and the yarn withdrawal nozzle 15 on a scale greater than that of FIG. 1. The opened fibers fed through the fiber guide conduit 17 into the rotor plate 3 are collected under the centrifugal force of the rotation of the rotor 2 as a fiber ring 24 in a circumferential rotor groove 25, and are progressively and continuously joined to a trailing yarn shank 27 extending from the yarn withdrawal nozzle 15 at a so-called tie-up zone 26, shown in FIG. 3, at which the fibers are drawn from the groove 25, become twisted with the yarn shank 27 to become part of the yarn 28 and are withdrawn with the yarn 28 from the rotor 2 through the yarn withdrawal nozzle 15. Spinning rotor 2 of FIG. 3 is shown without the conduit plate continuation 14 shown in FIG. 2 and without the yarn withdrawal nozzle 15. The rotor insert 18 includes the yarn guide conduit 20 that is curved at its terminal end in the area of the rotor groove 25 counter to the direction of rotation of the spinning rotor 2, represented in FIG. 3 by arrow 29. In addition, the four cylindrical permanent magnets 21 fixed in rotor insert 18 are arranged diametrically from one another and at the same radial spacing from the rotor axis 35. The rotor insert 18 is designed to have the smallest possible residual imbalance even before the balancing out procedure carried out during its manufacture. The recess 19 has an oblique surface 30 on its edge. This oblique edge surface 30 prevents short fibers loosened from the yarn 28 from becoming deposited in recess 19, but rather the short fibers are returned into rotor plate 3 on account of the rotation of rotor insert 18.

Figure 4:
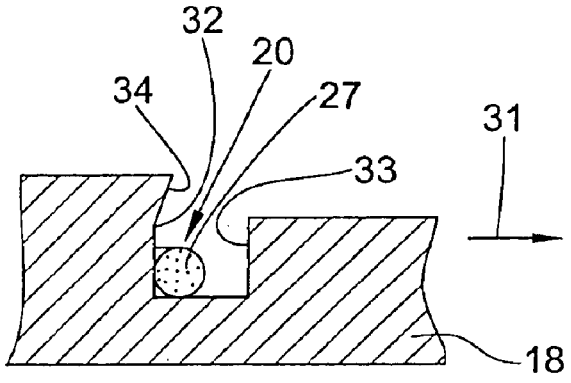
FIG. 4 is a partial enlarged view of the rotor insert of FIG. 3 taken along section line I—I through the yarn guide conduit.

As is known, a new spinning start is made in open-end rotor spinning devices at the start of a new batch or after a yarn break by an automatically operating joining carriage. If the spinning rotor 2 is loaded by the joining carriage with a rotary motion in the direction of the arrow 29, the rotary insert 18 also begins to rotate in the same direction as the spinning rotor 2 by the magnetic action of permanent magnets 21. Then, an appropriately prepared yarn end of a joining yarn is introduced through the yarn withdrawal tube 16 and into the spinning rotor 2. The yarn end rotates by means of contact with rotor insert 18 in the same direction as rotor insert 18 and reaches rotor groove 25, where the yarn end comes to rest on fiber ring 24 formed by the individual fibers. The joining yarn end rotates with the rotor insert 18 to extend to the rotor groove 25 at which individual fibers from the fiber ring 24 become joined and twisted therewith. As shown in FIG. 4, a rear side wall 32 of the yarn guide conduit 20 (as viewed in the direction of rotation of the rotor insert 18) is higher than the opposing front side wall 33 of the yarn guide conduit 20 (as similarly viewed in the direction of rotation), and such rear side wall 33 comprises in part an oblique surface 34. The rotor insert 18 rotates in the direction of arrow 31. As a consequence thereof, the yarn end of the joining yarn rotates initially as a free yarn shank but then is rapidly and reliably grasped and guided in yarn guide conduit 20. Alternatively, the rear wall 32 can be designed entirely as an oblique surface.

During the acceleration of spinning rotor 2 up to its operating speed during a new spinning start, the rotor insert 18 is likewise loaded in the same direction of rotation with a accelerating force. However, as a result of the withdrawal of yarn 28, the rotor insert 18 is prevented by the cooperation of the yarn shank 27 captured within the fiber guide conduit 20 from following the rotary motion of spinning rotor 2 with the same speed. The rotational speed of the rotor insert 18 results in this instance substantially from the rotational speed of rotor groove 25 minus the particular yarn withdrawal speed. The rotary motion of the rotor insert 18 is adjusted automatically and therefore does not need to be controlled.

Figure 5:
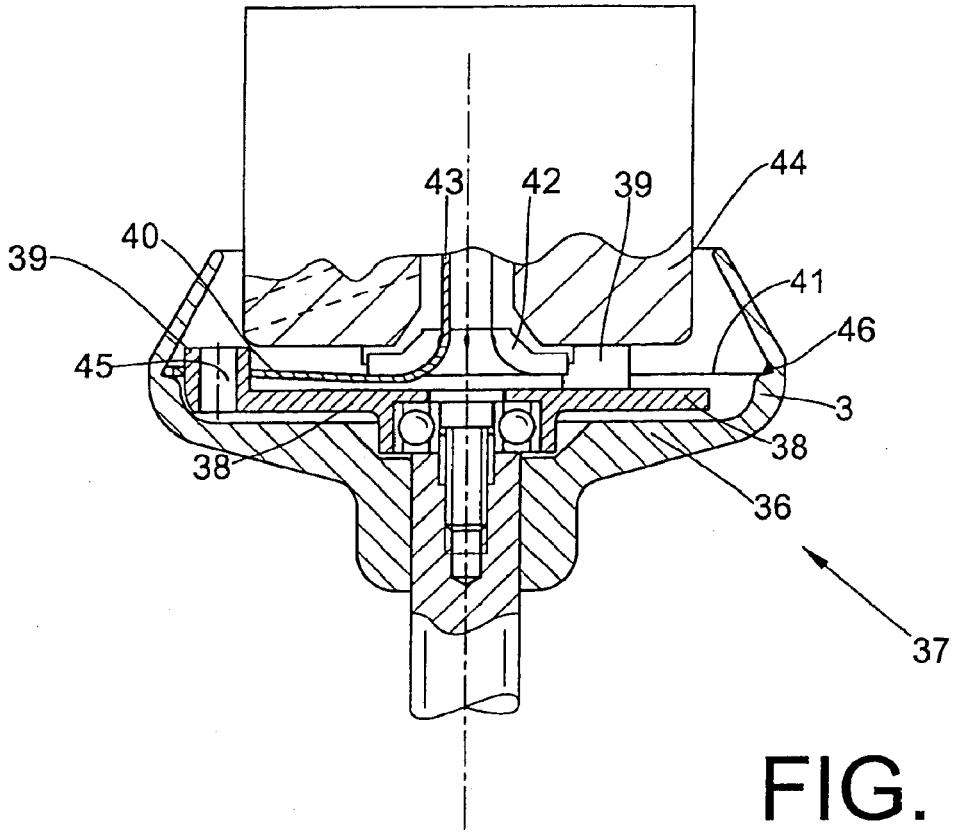
FIG. 5 is a schematic partial cross-sectional view of an open-end rotor spinning device according to another embodiment of the present invention wherein a rotor insert is equipped with yarn entrainment elements.
Figure 6:
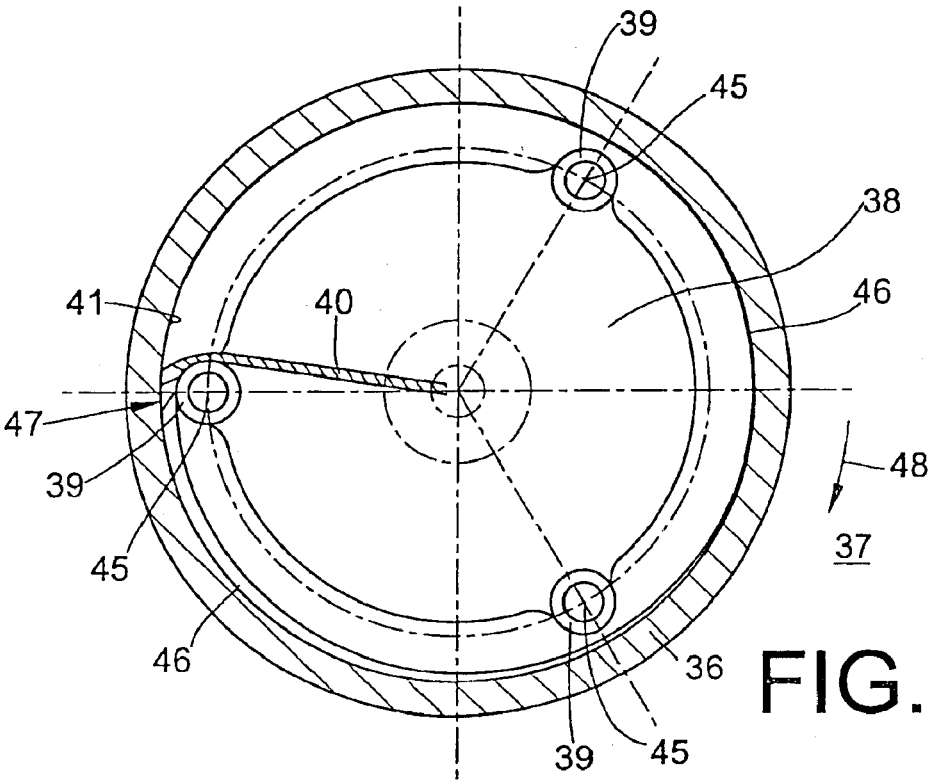
FIG. 6 is an end view in partial section of the spinning rotor of FIG. 5 showing the mounted rotor insert.

In an alternative exemplary embodiment of FIGS. 5 and 6, a rotor insert 38 rotatably supported in a rotor plate 36 of a spinning rotor 37 comprises three entrainment elements 39. The fibers fed into the rotor plate 36 are collected as a fiber ring 46 in rotor groove 41, recognizable in FIG. 5, and are joined at tie-up zone 47, shown in FIG. 6, to a yarn shank 40. One of the entrainment elements 39 guides the yarn shank 40. The fibers attaching to the yarn shank 40 are guided out of the rotor groove 41 in the direction of the yarn withdrawal nozzle 42 and withdrawn as yarn 43 through the yarn withdrawal nozzle 42. The spinning rotor 37 of FIG. 6 is shown without the conduit plate continuation 44 shown in FIG. 5 and without the yarn withdrawal nozzle 42. A permanent magnet 45 is fixed in each entrainment element 39. The direction of rotation of the spinning rotor 37 and of the rotor insert 38 is represented by arrow 48.

The invention is not limited to the exemplary embodiments described. Other embodiments are possible within the scope of the invention, in particular as regards the design of the rotor insert. It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device for spinning fibers into a yarn, the spinning device comprising a rotor housing, a spinning rotor disposed for rotation in the rotor housing for receiving the fibers to be spun into the yarn, a yarn withdrawal nozzle for withdrawal therethrough of the yarn, the spinning rotor having a circumferential rotor groove at a greatest inside diameter within the rotor for collecting the fibers to be spun into yarn, and the rotor defining a lagging fiber tie-up zone at which a yarn shank extends from the yarn withdrawal nozzle to the rotor groove in a curvature at least in the vicinity of the rotor groove counter to the direction of rotation of the rotor, a rotor insert rotatably supported within the rotor coaxially therewith, and a drive arrangement for causing the rotor insert to rotate in the direction of rotation of the spinning rotor at a rotational speed retarded during spinning operation from the rotational speed of the spinning rotor by an amount corresponding substantially to a lag of the tie-up zone, the rotor insert comprising a guide portion for guiding the yarn shank between the rotor groove and the yarn withdrawal nozzle and for supporting the curvature of the yarn shank counter to the direction of rotor rotation in all spinning phases.

2. The open-end spinning device according to claim 1, wherein during normal spinning operation, the yarn shank in association with the yarn guide delays the rotor insert in comparison to the drive arrangement synchronous with the spinning rotor.

3. The open-end spinning device according to claim 1, wherein the drive arrangement for the rotor insert comprises a contactless coupling to the spinning rotor.

4. The open-end spinning device according to claim 3, wherein the contactless coupling for the rotor insert comprises permanent magnets arranged concentrically.

5. The open-end spinning device according to claim 1, wherein the yarn guide comprises a yarn guide conduit having an entrance opening on a side of the rotor insert facing the rotor groove, the yarn guide conduit being configured to support the curvature of the yarn shank counter to the direction of rotor rotation.

6. The open-end spinning device according to claim 5, wherein the rotor insert has surfaces bordering front and rear sides of the yarn guide conduit as viewed in the direction of rotation of the yarn guide conduit, the rear side surface forming an extension of the yarn guide conduit.

7. The open-end spinning device according to claim 1, wherein the rotor insert has a central recess having an oblique edge surface for partially receiving the yarn guide conduit in a closed position of the open-end spinning device.

8. The open-end spinning device according to claim 6, wherein the rear side surface of the yarn guide conduit is configured to capture the yarn shank.

9. The open-end spinning device according to claim 1, wherein the yarn guide is comprises a yarn entrainment element.

10. The open-end spinning device according to claim 9, wherein the yarn guide comprises plural entrainment elements for guiding of the yarn shank by one of the entrainment elements.

11. The open-end spinning device according to claim 10, wherein each of the entertainment elements comprise a permanent magnet.

12. A spinning rotor for use in an open-end spinning device, the spinning rotor defining a lagging fiber tie-up zone at which a yarn shank extends to a circumferential rotor groove in a curvature at feast in the vicinity of the rotor groove counter to the direction of rotation of the rotor, and the spinning rotor comprising a rotor insert configured to be rotatably supported within the rotor coaxially therewith for cooperation with the spinning rotor in the spinning of fibers with the yarn shank, the rotor insert comprising an arrangement for cooperation with the spinning rotor for causing the rotor insert to rotate in the direction of rotation of the spinning rotor at a rotational speed retarded from the rotational speed of the spinning rotor by an amount corresponding substantially to a lag of the tie-up zone, and the rotor insert further comprising a guide portion for guiding the yarn shank between the rotor groove and the yarn withdrawal nozzle and for supporting the curvature of the yarn shank counter to the direction of rotor rotation in all spinning phases.

13. A method of open-end spinning of fibers into a yarn, the spinning method comprising the steps of: delivering opened fibers into a rotating spinning rotor, centrifugally collecting the fibers in a circumferential rotor groove at a greatest inside diameter within the rotor, extending a yarn shank into the rotor groove with the yarn shank forming a curvature at least in the vicinity of the rotor groove counter to the direction of rotation of the rotor for defining a lagging fiber tie-up zone for progressively attaching the collecting fibers to the yarn shank, rotating a rotor insert within the rotor coaxially therewith in the direction of rotation of the spinning rotor at a rotational speed retarded from the rotational speed of the spinning rotor by an amount corresponding substantially to a lag of the tie-up zone, and guiding the yarn shank for maintaining the curvature of the yarn shank counter to the direction of rotor rotation.

* * * * *